US006675484B2

(12) United States Patent
McHenry et al.

(10) Patent No.: US 6,675,484 B2
(45) Date of Patent: Jan. 13, 2004

(54) FOLDING TOOL LOCKING MECHANISM

(75) Inventors: William J. McHenry, Wyoming, RI (US); Jason L. Williams, Glocester, RI (US)

(73) Assignee: Mentor Group LLC, Oregon City, OR (US)

( * ) Notice: Subject to any disclaimer, the term of this patent is extended or adjusted under 35 U.S.C. 154(b) by 19 days.

(21) Appl. No.: 09/918,695

(22) Filed: Jul. 30, 2001

(65) Prior Publication Data

US 2003/0019108 A1 Jan. 30, 2003

(51) Int. Cl.[7] ..... B26B 1/04
(52) U.S. Cl. ..... 30/161; 81/177.4
(58) Field of Search ..... 30/160, 161; 81/440, 81/177.8; 7/118

(56) References Cited

U.S. PATENT DOCUMENTS

| | | | | |
|---|---|---|---|---|
| 436,888 | A | | 9/1890 | Von Buitzingslowen et al. |
| 821,176 | A | | 5/1906 | Leland |
| 969,909 | A | | 9/1910 | Schrade |
| 1,179,111 | A | | 4/1916 | Knowlton |
| 1,258,150 | A | | 3/1918 | Schrade |
| 1,413,954 | A | | 4/1922 | Ball et al. |
| 1,888,887 | A | | 11/1932 | Readman |
| 2,197,136 | A | | 4/1940 | Share et al. |
| 2,580,495 | A | | 1/1952 | Woods |
| 2,681,244 | A | | 6/1954 | Noecker |
| 3,313,564 | A | | 4/1967 | Pultz |
| 3,496,590 | A | | 2/1970 | Yates |
| 3,990,471 | A | | 11/1976 | Schutzer et al. |
| 4,005,525 | A | | 2/1977 | Gringer |
| 4,200,977 | A | | 5/1980 | Kageyama et al. |
| 4,277,888 | A | | 7/1981 | Szabo |
| 4,354,313 | A | | 10/1982 | Naifeh |
| 4,407,538 | A | | 10/1983 | Bauer |
| 4,447,950 | A | | 5/1984 | Mizelle |
| 4,663,845 | A | | 5/1987 | Weimann |
| 4,860,790 | A | | 8/1989 | Scaramucci |
| 4,939,839 | A | | 7/1990 | Gorst |
| 4,947,552 | A | * | 8/1990 | Barnes ..... 30/161 |
| 4,985,998 | A | | 1/1991 | Howard |
| 5,104,164 | A | | 4/1992 | Sieg |
| 5,515,610 | A | | 5/1996 | Levin et al. |
| 5,546,662 | A | | 8/1996 | Seber et al. |
| 5,621,973 | A | | 4/1997 | Seber et al. |
| 5,737,841 | A | | 4/1998 | McHenry et al. |
| 5,875,552 | A | | 3/1999 | Chen |
| 5,909,930 | A | | 6/1999 | Ragland, III et al. |
| 6,122,829 | A | | 9/2000 | McHenry et al. |
| 6,170,104 | B1 | * | 1/2001 | Seber et al. ..... 7/118 X |
| 6,223,628 | B1 | | 5/2001 | Barron |
| 6,226,873 | B1 | | 5/2001 | Okumura |
| 6,269,993 | B1 | | 8/2001 | Ebejer et al. |
| 6,393,628 | B1 | | 5/2002 | Kellogg |

OTHER PUBLICATIONS

U.S. patent application Ser. No. 09/918658, McHenry et al.

* cited by examiner

*Primary Examiner*—Douglas D. Watts
(74) *Attorney, Agent, or Firm*—ipsolon llp

(57) ABSTRACT

A folding tool such as a knife or multitool and the like has a resilient lever arm formed in a body portion. A blade pivotally connected to the body is movable between closed and open positions. A blade locking pin is carried on the lever arm, and in the normal resting position the blade locking pin engages the blade. When the blade is in the open position the lever arm biases the locking pin into locking engagement with a notch formed in the blade tang, thereby locking the blade in the open position. Actuating the lever arm disengages the locking pin from the blade, allowing the blade to be moved into the closed position. The blade may have a second notch or hole formed in the tang for engagement of the blade locking pin when the blade is closed, thereby locking the blade into the closed position.

44 Claims, 7 Drawing Sheets

FOLDING TOOL LOCKING MECHANISM

FIELD OF THE INVENTION

This invention relates generally to locking mechanisms for use with folding tools such as pocket knives and other hand tools. More particularly, the invention relates to a sturdy and easily operable mechanism that locks the working portion of a tool in an open position, and allows the working portion to be quickly moved into a closed position.

BACKGROUND INFORMATION

Folding tools such as knives and the popular "multitools" have become ubiquitous and are well known in the art. Such tools are suitable for many purposes, and the following U.S. patents are just a few of the many that describe useful innovations in the field of knives: U.S. Pat. No. 1,030,058 to Doles, U.S. Pat. No. 1,189,005 to Seely, U.S. Pat. No. 2,188,762 to Schrade, U.S. Pat. No. 3,868,774 to Miori, U.S. Pat. No. 4,2233,737 to Poehlmann, U.S. Pat. No. 4,240,201 to Sawby et al., U.S. Pat. No. 4,274,200 to Coder, U.S. Pat. No. 4,451,982 to Collins, U.S. Pat. No. 4,502,221 to Pittman, U.S. Pat. No. 4,670,984 to Rickard, U.S. Pat. No. 4,837,932 to Elsener, U.S. Pat. No. 4,896,424 to Walker, U.S. Pat. No. 5,060,379 to Neely, U.S. Pat. No. 5,425,175 to Rogers, U.S. Pat. No. 5,461,786 to Miller, U.S. Pat. No. 5,737,841 and U.S. Pat. No. 6,122,829 both to McHenry et al. There are many other patents that describe useful innovations in the field of other folding tools.

Locking mechanisms are useful additions to folding tools, and many of the aforementioned patents describe different mechanisms for locking tool blades in an open position. For example, the patents to Sawby et al., Miller and Seely each disclose a variation of a "lock back" mechanism. This construction entails forming a notch on a tang of the blade that is engaged by a lug located on the spine of the knife to lock the blade in an open position. The patents to Neely and Collins each disclose another type of locking mechanism. As disclosed in these patents, a blade has a tang that is engaged by a member to prevent the blade from rotating from its open position. For example, in Collins, a slidable bolt is biased towards the tang to lock the blade in its open position. A shortcoming with Collins's knife construction is that the bolt is generally parallel with the blade, and the mechanism depends on the spine of the handle for strength. Neely's knife suffers from the same disadvantage as Collins', and from the fact that the blade may be unlocked inadvertently by pulling the blade axially away from the handle during a normal cutting motion of the knife. The two patents mentioned above to McHenry et al. describe yet another blade locking mechanism in which a spring biased pin extending transverse to the blade is longitudinally movable in the handle and engages the tang of the blade to lock it in the open position. This locking mechanism is exceedingly strong and easy to operate.

Despite the many different kinds of locking mechanisms there is a need for still a greater variety of devices that allow the working portion of a folding tool —whether the tool is a knife blade or a pliers—to be reliably locked in the open position.

SUMMARY OF THE INVENTION

The present invention provides a locking mechanism for a folding tool that is structurally distinct from the prior art. The locking mechanism described herein is strong and reliable, easily operated, versatile and aesthetically attractive.

The mechanism is adaptable to virtually any folding tool, including knives, multitools, and other hand tools of a similar nature. It is described herein in accordance with one preferred embodiment of a knife. The knife comprises an elongate handle having opposed body side wall sections defining an elongate slot or groove therebetween. At least one knife blade is pivotally attached to the handle at one end. The blade is movable between a closed position in which the blade is received within the groove of the handle, and an open position in which the blade is extended away from the handle and exposed. The blade has a working portion that extends away from the handle when in its open position and a tang portion, which is located within the groove of the handle when the blade is in its open position.

In one preferred embodiment, one of the side wall sections defines a panel having a pair of opposed and overlapping, generally U-shaped slots formed therein. The side wall is formed of a resilient material and the slots are overlapping such that in combination they define a pivoting lever arm mechanism that is integrally connected with opposite spring arms. When a central section of the side wall section between the grooves is pushed inwardly in the direction toward the groove between the body side walls, the opposite, free end of the lever arm moves outwardly, away from the handle. A locking pin is carried on the lever arm and extends inwardly in the handle toward engagement with the blade. Since the side wall is resilient, the locking pin is normally biased toward the blade. When the blade is in the closed position the locking pin projects through a hole in the tang of the blade and thus engages the blade, locking it in the closed position. The blade is unlocked and moved into the open position by actuating the lever arm by pushing one end inwardly, toward the blade. This pivots or rocks the free end of the lever arm and thus moves the locking pin out of engagement with the tang. The engagement between the locking pin and the blade tang is thus released, allowing the blade to be pivoted about the shaft that connects the blade to the handle. The blade may be rotated to the open position. When in the fully open position the locking pin is biased into a cooperatively formed notch in the peripheral edge of the tang. The blade is locked in this open position until the lever arm is again actuated to release the locking pin from engagement with the notch. A standard blade stop pin is preferably used to stop rotational travel of the blade as it rotates from the closed to the open position.

The lever arm locking mechanism may be formed in a variety of different configurations, and the mechanism may optionally be used in combination with a fulcrum positioned between the body half that carries the lever arm and the blade.

BRIEF DESCRIPTION OF THE DRAWINGS

The invention will be better understood and its numerous objects and advantages will be apparent by reference to the following detailed description of the invention when taken in conjunction with the following drawings.

DETAILED DESCRIPTION OF THE PREFERRED EMBODIMENTS

Figure 1:
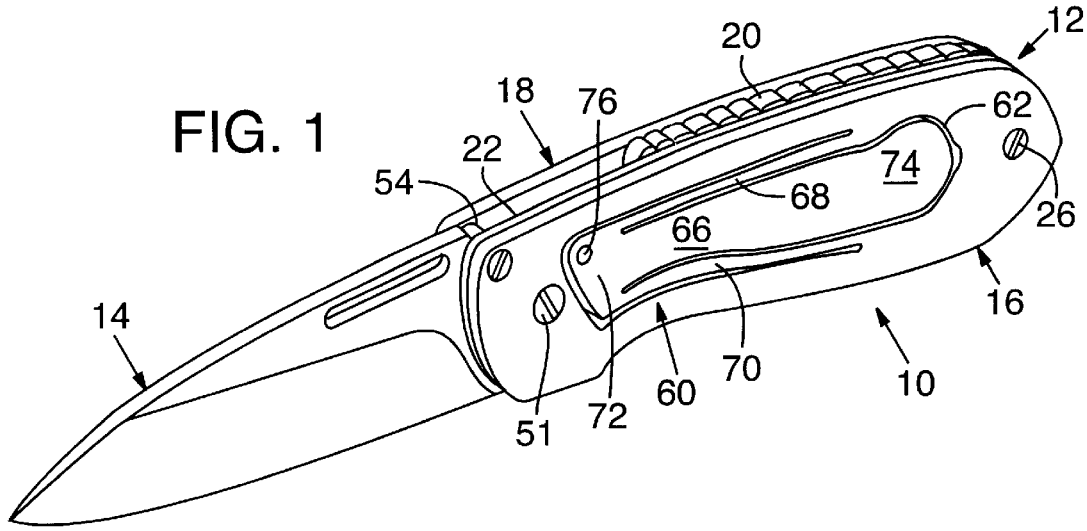
FIG. 1 is a perspective view of a folding pocket knife embodying the present invention, a blade of the knife shown in an open or extended position in which the blade is in the normal operating position.
Figure 2:
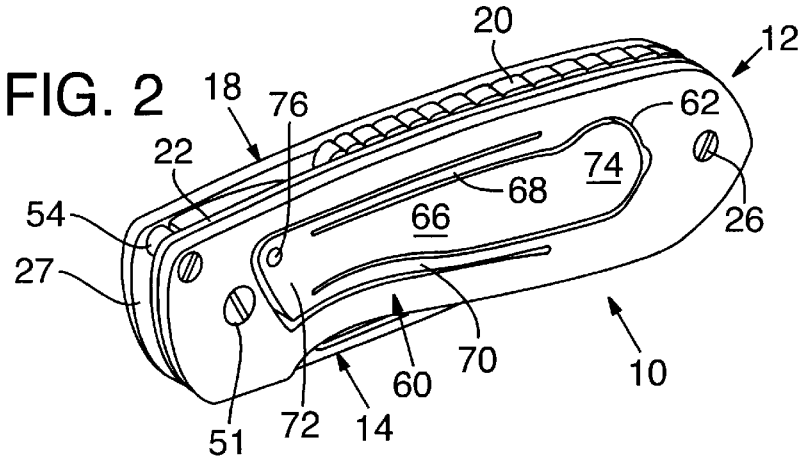
FIG. 2 is a perspective view of the knife shown in FIG. 1, with the blade of the knife being shown in the closed position in which the blade is received in a groove defined between the handle body halves.

Referring now to the drawings, and more particularly to FIG. 1, folding knife 10 includes a blade locking mechanism that embodies the present invention. Knife 10 includes an elongate handle 12, and a blade 14 that is pivotally attached to the handle at one of its opposite ends. Blade 14 is movable between the open position shown in FIG. 1, where the working portion of the blade is exposed, and the closed position shown in FIG. 2, where the working portion of the blade is received within handle 12. The locking mechanism of the present invention, described in detail below, allows the knife blade to be securely locked in the open position of FIG. 1 to prevent inadvertent movement of the blade to its closed position (FIG. 2). Likewise, knife 10 may be securely locked in the closed position.

Figure 3:
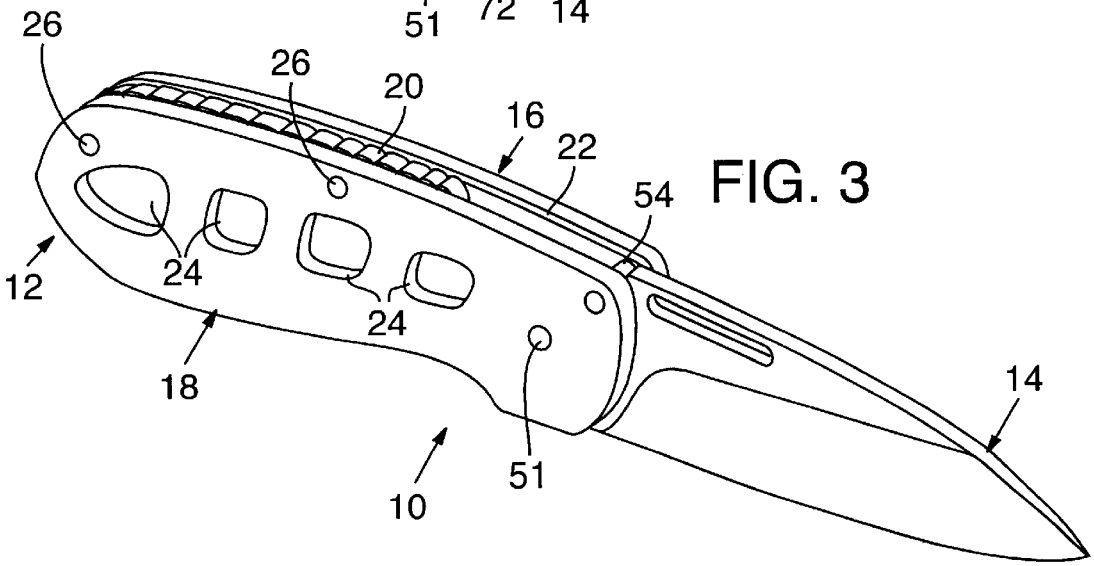
FIG. 3 is a perspective view of the folding pocket knife shown in FIG. 1, with the knife blade in the open position, and the figure showing the opposite side of the knife from FIG. 1.
Figure 4:
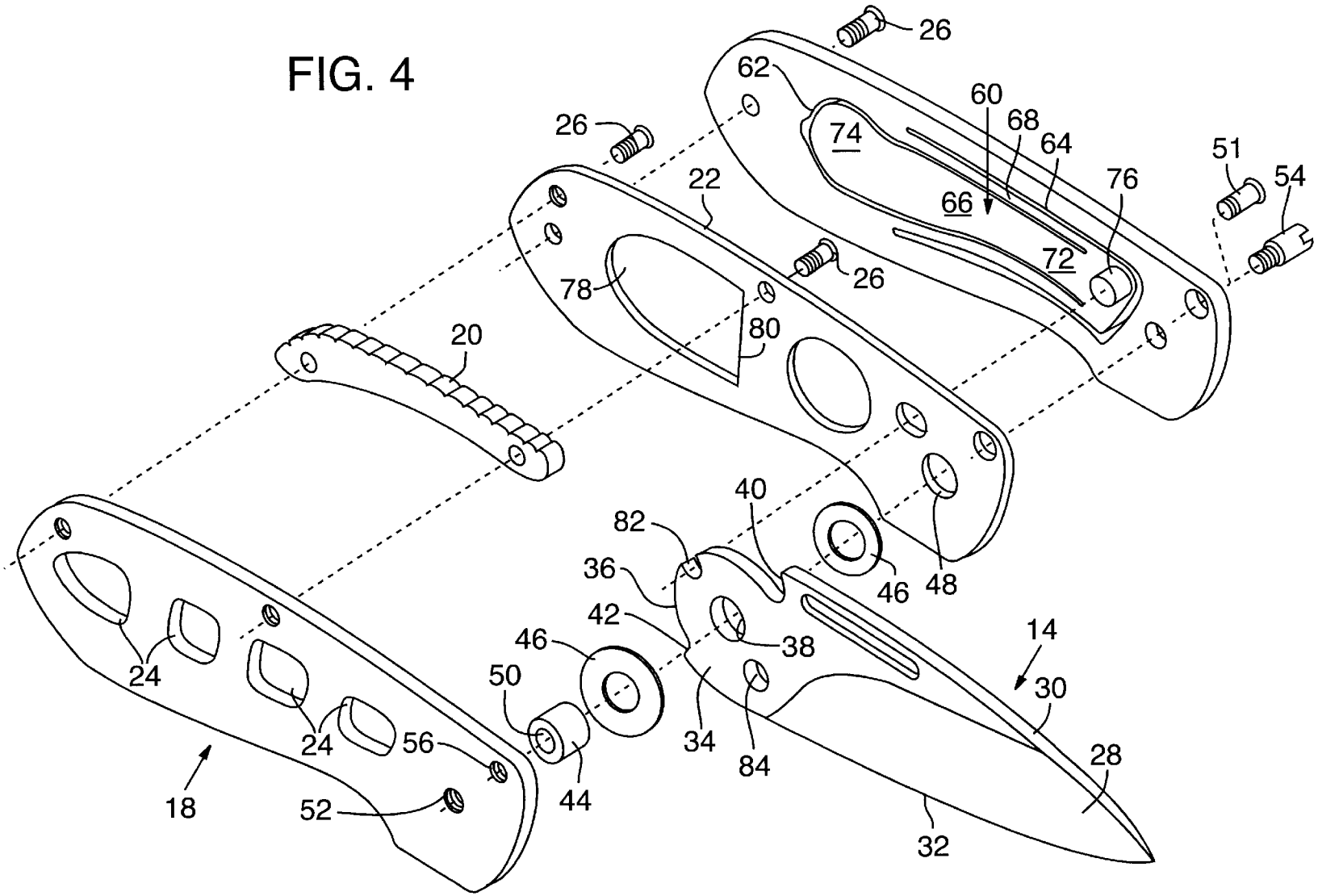
FIG. 4 is a perspective exploded view of the knife shown in FIG. 3.

With reference to FIGS. 1–4, handle 12 of comprises several components, including a pair of oppositely located side wall sections, generally indicated at right side wall 16 and left side wall 18. The side walls are oriented generally parallel with each other, and a spine 20 is located between the side wall sections along their upper long edges. Spine 20 separates the side wall sections in spaced apart relationship and thus defines a groove or slot between the side wall sections for receiving blade 14. As best shown in FIG. 4, an inner plate 22 is disposed inwardly alongside side wall 16 and between side wall 16 and spine 20. With reference to FIGS. 3 and 4, side wall 18 is shown with plural openings 24. Openings 24 are optional and may be included for several purposes, including decreasing the weight of the handle, making it easier to clean, and for aesthetics. If included their number and positions may be varied in whatever manner desired.

When handle 12 is assembled, spine 20 is disposed between the inner plate 22 and side wall 16, and side wall 18, respectively, and extends along the upper edge margins of the side wall sections. Suitable fasteners such as screws 26 are used to hold together the side walls 16, 18 and inner plate 22. As described below, side wall 16, which carries the locking mechanism, is fabricated from a resilient material such as spring steel. However, other suitable materials such as titanium, various plastics, etc., may be used. Likewise, side wall 18 and inner plate 22 may be fabricated from a like variety of materials, including reinforced hard synthetic plastics such as Micarta™. Nonetheless, the side walls 16 and 18 are preferably fabricated from steel since these components of the handle must be strong enough to bear the forces that might be exerted thereon when locking the blade in its open position.

Figure 5:
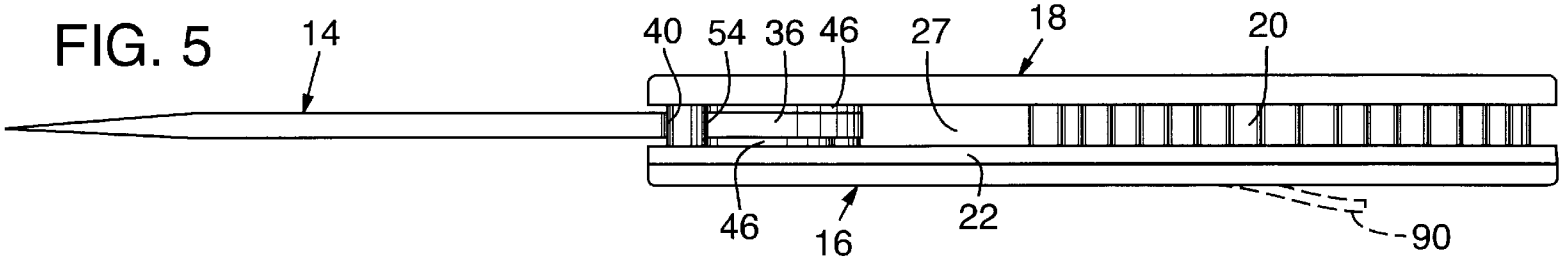
FIG. 5 is a top plan view of the knife shown in FIG. 1.
Figure 6:
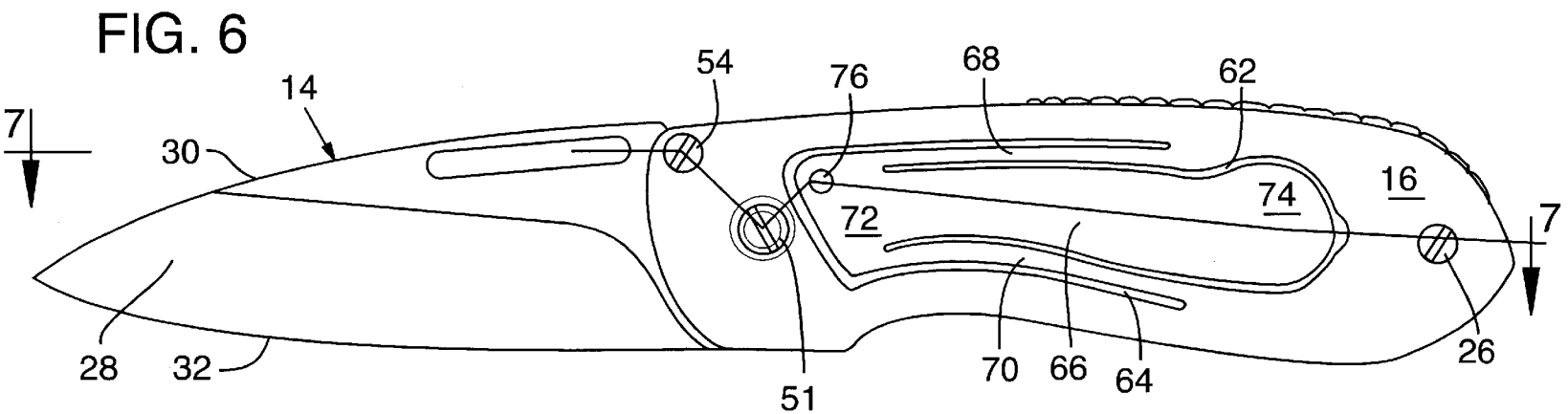
FIG. 6 is a left side elevational view of the knife shown in FIG. 5.

The side wall sections 16, 18 and the spine section 20 define a blade receiving slot 27 (see FIG. 5) for receiving blade 14 when it is moved to its closed position. With reference to FIG. 4, blade 14 is a standard knife blade that comprises an elongate working portion 28 having an upper blunt edge or back 30, a lower sharp edge 32, and a tang portion 34, which pivotally attaches the blade to the handle. The arrangement is such that the blade's working portion 38 extends away from the handle when the blade is in its open position (FIG. 1), and tang portion 34 is located within slot 27 when the blade is in either the open or the closed position (FIG. 2). That is, the tang portion 34 is always located between the side wall 18 on the one side, and inner plate 22 on the other side.

Stated in more detail, the working portion 28 of blade 14 is constructed in a well-known manner and the blade is pivotally attached to the handle by the tang portion 34 so that the lower sharp edge 32 is received within handle 12 when the blade is in the closed position. The tang portion 34 is formed integrally with the working portion 28 and has a semi-circularly-shaped rearward peripheral edge 36. A circular opening 38 is formed in the tang for attaching blade 14 to handle 12. The upper and forward end of the peripheral edge 36 (when the blade is in the open position, FIG. 4) of tang portion 34 defines an upwardly extending shoulder 40. The other end of peripheral edge 36, that is, the lower forward end of edge 36 defines a shoulder 42. Shoulders 40 and 42 are defined by generally perpendicular edges with respect to the direction of the peripheral edge 36 at their respective junctions. However, as illustrated in FIG. 4, shoulder 42 is characterized as having a greater radius of curvature than shoulder 40.

As shown in FIG. 4, an annular shaft 44, preferably fabricated from hard steel, attaches blade 14 to handle 12 with a pair of annular shims 46, one on each side of blade 14 between the side wall 18 on the one side, and inner plate 22 on the other side of the blade. Shaft 44 is typically press-fitted into opening 38 formed in the tang portion 34 of the blade and fits rotatably but snugly through a cooperatively formed circular opening 48 defined in inner plate 22. In this way shaft 44 defines a pivot axis for the blade extending transversely with respect to the side walls 16 and 18. Shims 46 are received over respective ends of the shaft 44 as indicated in FIG. 4. Shaft 44 has an axial bore 50 machined therethrough for receiving a fastener such as screw 51, which extends through side wall 16, inner plate 22, shaft 44 (through bore 50), and is secured in a threaded opening 52 in side wall 18. A stop pin 54 extends through side wall 16, inner plate 22 and is threaded into a threaded opening 56 in side wall 18. As detailed below, stop pin 54 stops the rotational travel of blade 14 as it rotates into the open position when shoulder 40 abuts the stop pin.

Locking Mechanism

A first preferred embodiment of the locking mechanism is shown in FIGS. 1 through 9, and is designated generally with reference number 60. Locking mechanism 60 comprises an elegantly simple mechanical device that is remarkably versatile with respect to its ability to latch and unlatch, release and secure objects. It is described herein in terms of a preferred embodiment as it relates to a folding tool—a knife. Those skilled in the art will readily appreciate the versatility of the design. Moreover, a locking mechanism that utilizes the same or equivalent mechanical and structural principles as the preferred embodiments described herein may be built in any number of configurations. Some of those alternatives are described herein. However, those skilled in the art will recognize that other design variations may be made that are equivalent to the mechanisms described below and shown in the Figures.

With reference to FIG. 1 and as described in detail below, locking mechanism 60 is characterized by a lever arm that is integrally connected with spring arms. The mechanism is preferably fabricated from a unitary piece of material and as such, the lever arm and the spring arms are defined by the material from which the mechanism is constructed and are thus integrally connected to the spring arms. Although in one preferred embodiment the locking mechanism is formed from a unitary piece of material, the locking mechanism may be constructed from multiple pieces connected to one another. The word unitary will thus be understood to refer to a mechanism that is either fabricated from a monolithic piece of material, or from multiple pieces that are connected in an appropriate manner to allow the interconnected pieces to perform as a monolithic piece. In a normal, relaxed or neutral position, the spring-powered locking mechanism is in the locked position, shown in FIG. 1. The material from which the locking mechanism is fabricated has a "memory," such that the material returns to the neutral position when no outside forces are acting on the mechanism. One end of the lever arm carries a locking pin or similar device for engaging the blade. The end of the lever arm that carries the locking pin is pivoted away from the knife handle in response to pressure exerted on the opposite end of the lever arm. Stated in another way, as one end of the lever arm is pushed in one direction, the opposite end of the lever arm moves in the opposite direction. This mechanical linkage is used to lock and unlock the blade.

In the embodiment of FIGS. 1 through 9, a fulcrum is located inwardly of the lever arm to assist the free end of the lever arm to lift or rock a locking pin away from the resting or locked position.

Locking mechanism 60 is defined in FIGS. 1 through 9 by a pair of overlapping, generally U-shaped slots formed in side wall 16. As noted, side wall 16 is fabricated from a resilient material such as spring steel, although many different resilient materials, including plastic, may be used. Side wall 16 is preferably a unitary piece of steel cut into the desired shape. A pair of generally U-shaped slots are cut completely through the side wall. The first slot, or inner slot 62, is oriented on side wall 16 such that the "open" portion of the U shape faces toward the "front" end of the handle. That is, toward the end of the handle where the blade is attached. The second, or outer slot 64 overlaps inner slot 62 with the open portion of the slot oriented in the opposite direction, toward the rear of the handle. This combination of the opposed and overlapping U-shaped slots defines a central lever arm 66 and two opposed spring arms 68, 70, on one each side of the central lever arm where the opposed slots overlap. The two spring arms are formed from the same, monolithic section of side wall 16, and the spring arms are thus integrally connected to the central lever arm. The forwardmost end of the combined overlapping slots, that is, the portion of side wall 16 toward the front end of the handle and bounded by the U of outer slot 64 is labeled with reference number 72, and defines a lifting portion 72. Lifting portion 72 defines the free end of the locking mechanism since it may be lifted away from the resting position shown in FIG. 1. The rearwardmost end of the combined slots, that is, the portion of central lever arm 66 that is bounded by the U of inner slot 62 is labeled with reference number 74, and defines an actuating portion 74. A locking pin 76 is carried on lifting portion 72 and extends inwardly in handle 12 toward blade 14. Locking pin may be a separate piece that is connected to the lifting portion, as shown, or may be of any number of configurations such as a bent-over tab.

Figure 8:
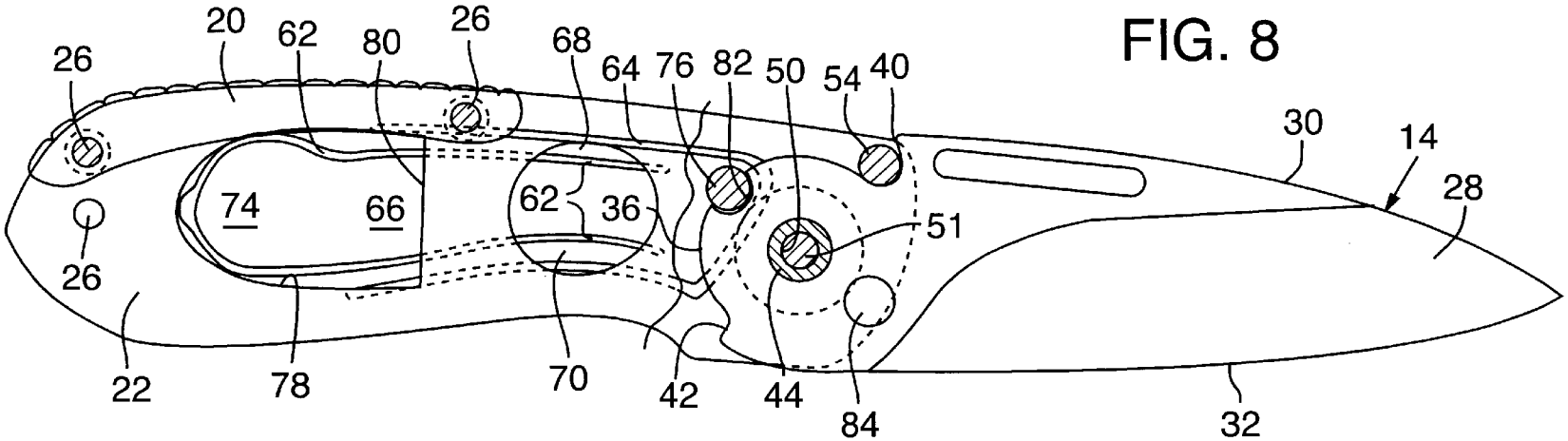
FIG. 8 is a right side elevational view of the knife shown in FIG. 6 with the right hand side wall of the knife removed to expose the blade, which is in the open position, and the locking mechanism.
Figure 9:
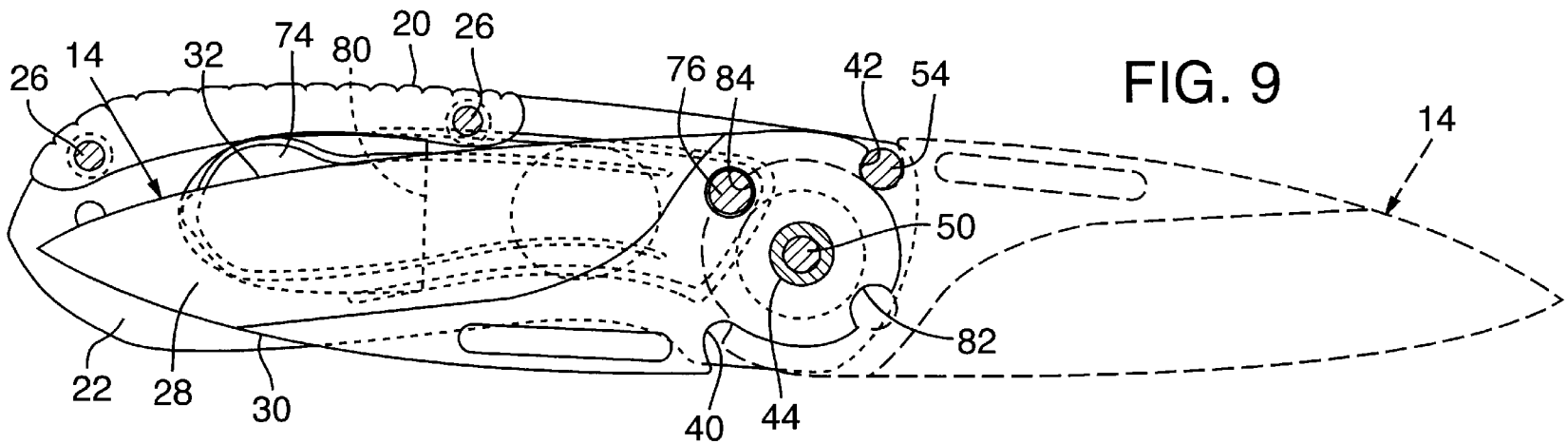
FIG. 9 is a right side elevational view as in FIG. 8 with the blade shown in the closed position, the blade in the open position shown in phantom lines.

With reference to FIG. 4 it will be seen that inner plate 22 has an opening 78. Opening 78 is shaped cooperatively with actuating portion 74 of central lever arm 66, and as may be seen in FIG. 8, opening 78 is sized slightly larger than actuating portion 74 such that the actuating portion fits into the opening. When side wall 16 is assembled with inner plate 22 the actuating portion of central lever arm 66 aligns with opening 78 (FIG. 8). The forwardmost edge of opening 78 is given reference number 80. When side wall 16 and inner plate 22 are assembled, edge 80 is positioned such that it lies adjacent to and inwardly of central lever arm 66 approximately midway along the length of the central lever arm.

Figure 7:
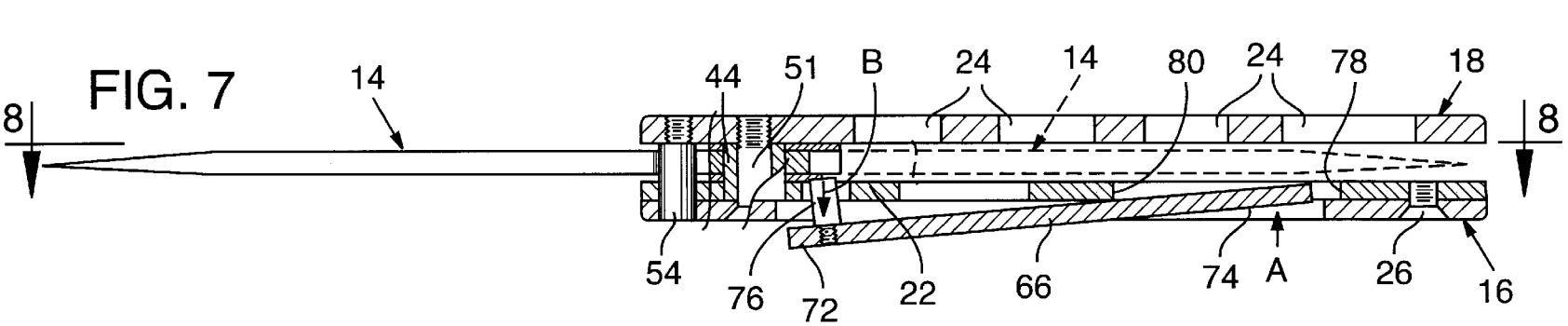
FIG. 7 is a top, partial cross sectional view taken along the line 7—7 of FIG. 6.

With reference to FIG. 7 the operation of locking mechanism 60 will be apparent. Pressure applied against actuating portion 74 of central lever arm 66 in the direction of arrow A drives the actuating portion inwardly toward the center of handle 12, that is, toward slot 27. Simultaneously, the free end of the lever arm, that is, lifting portion 72 moves in the opposite direction, that is, the direction of arrow B in FIG. 7. Forwardmost edge 80 of inner plate 22 acts as a fulcrum upon which central lever arm 66 pivots. As actuating portion 74 moves inwardly in the direction of arrow A, the actuating portion is pushed into opening 78 in inner plate 22. The width of inner plate 22 thus provides for a greater distance through which actuating portion 74 may move, and a correspondingly greater distance that lifting portion 72 travels. The corresponding distance that lifting portion 72 moves in the direction of arrow B is determined in this instance by the position of the fulcrum defined by edge 80, and by the distance that the actuating portion may be pushed toward slot 27. Stated otherwise, with edge 80 positioned as shown in FIG. 7—approximately midway along the length of central lever arm 66, movement of actuating portion 74 over a distance of X in direction A, corresponds to movement of lifting portion 72 in direction B of about X. If opening 78 is enlarged such that edge 80 is shifted forward (i.e., toward shaft 44), movement of actuating portion 74 over a distance of X in direction A, will result in a corresponding movement of lifting portion 72 in direction B that is somewhat less than X. It will also be appreciated in this instance that the amount of force necessary to drive the actuating portion inwardly will be relatively less than in the case illustrated in FIG. 7. On the other hand, if opening 78 is reduced in size such that edge 80 is shifted rearward (i.e., away from shaft 44), movement of actuating portion 74 over a distance of X in direction A, will result in a corresponding movement of lifting portion 72 in direction B that is somewhat greater than X. It will be appreciated in this later instance that the amount of force necessary to drive the actuating portion inwardly will be relatively greater.

The "throw" of lifting portion 72—that is, the distance that lifting portion 72 travels, is thus adjustable by the position of edge 80 relative to the central lever arm. It will be appreciated that by changing the thickness of inner plate 22, the throw of the lifting portion may similarly be changed.

As noted, side wall 16 is fabricated from a resilient material such as spring steel. In the embodiment shown in FIGS. 1 through 9, the normal resting position of locking mechanism 60 is such that the central lever arm 66 is flush against the outer side of the handle (FIGS. 4, 1 and 2). Because the side wall 16 is resilient, pressure applied against actuating portion 74 in direction A (FIG. 7) is resisted by the biasing resilience of opposed spring arms 68 and 70, which as noted are integrally attached to the lever arm. The amount of this biasing resistance—the spring force, may be adjusted by the relative widths of these opposed lever arms and also by the thickness of the material used to fabricate the side wall itself. The force needed to actuate the locking mechanism 60 may be varied by changing these factors. Moreover, while it is preferable to build locking mechanism 60 from a unitary blank of material, an equivalent locking mechanism may be made from several pieces connected together.

Turning now to the specifics of operation of locking mechanism 60 with blade 14, it will be seen in FIG. 4 that a notch 82 is formed in the peripheral edge 36 of tang 34. An opening 84 is formed into tang 34. Referring to FIG. 8 in which blade 14 is locked in the open position it will be seen that in this position, locking pin 76 is received in and engages notch 82 and stop pin 54 abuts shoulder 40. The resilient biasing action of locking mechanism 60 maintains this locking position and the blade is thus locked securely in the open position. The blade remains in this position and resists closing forces that may be applied to the blade during use. The blade remains in the open position until the locking mechanism is actuated to unlock the blade. This is accomplished by pressure being applied in the direction of arrow A (FIG. 7) until locking pin 76 is moved in the direction of arrow B a sufficient distance that the pin clears or disengages from notch 82. At this point blade 14 may be freely rotated about shaft 44 into the second, or closed position shown in FIG. 9. Blade 14 continues rotation toward the closed position until the blade is received in slot 27, at which point locking pin 76 aligns with opening 84 in tang 34. When the locking pin is aligned with the opening, the biasing force of the locking mechanism pushes the locking pin into the opening, thereby locking the blade in the closed position.

Blade 14 is moved into the open position from the closed position by again actuating the locking mechanism (as described above) until locking pin 76 clears or disengages from opening 84. The blade may then be freely rotated about shaft 44 until in the open position of FIG. 8, where locking pin engages notch 82. Although the particular locking pin 76 shown in the figures is circular in cross section, the pin could be of virtually any design that engages a cooperatively formed portion of the tang.

There are numerous alternate embodiments that are equivalent to the preferred embodiment described above. For example, inner plate 22 is optional and is used to provide a fulcrum and to provide a throw distance that increases the travel of, for instance, the locking pin. However, with reference to FIG. 5, a first alternative is shown in which opening 78 in inner plate 22 may be omitted, or alternately, in which inner plate 22 may be eliminated altogether. Thus, in FIG. 5 central lever arm 66 is shown in phantom lines such that in the resting position the actuating portion 90 is bent outwardly away from side wall 16 such that actuating portion 90 is not flush with the side wall. As noted, this structure allows for either elimination of opening 78 in the inner plate or elimination of the inner plate, yet the locking pin may be moved through a sufficient distance to allow for locking and unlocking as described above. Thus, if central lever arm 66 is bent outwardly as shown with actuating portion 90, then the lever arm acts as the fulcrum where it abuts a surface inwardly of the lever arm. The surface itself thus acts as a fulcrum where it abuts the inner-facing surface of the actuator arm. Moreover, with an actuating portion that is bent outwardly as with actuating portion 90, the locking mechanism has enough force even without an underlying surface to raise the free end of the lever arm out of the resting locked position. That is, even without an underlying surface, pushing actuating portion 90 inwardly will cause the lifting portion 72 to move in the opposite direction to effect unlocking of the blade.

Those skilled in the art will readily appreciate that the position and orientation of the locking mechanism relative to both the handle and blade may be varied widely. For example, the particular structures used to lock the blade in the open and closed positions may be varied widely with the same basic locking mechanism. Similarly, the mechanism may be oriented within the handle in a variety of ways. As one example, the longitudinal axis defined by the central lever arm may be oriented transverse to the longitudinal axis of the knife handle. Moreover, the lifting portion of the central lever arm may itself be used to engage the tang of the blade, as in the example of a typical liner locking mechanism. In this configuration, the free end of the lever arm normally extends inwardly toward the blade such that it is in an engaging relationship with a cooperatively formed edge on the tang of the blade. Actuating the actuating portion of the lever arm lifts the lifting portion out of the engaging relationship to unlock to blade. Further, the blade-engaging pin may engage the blade in any convenient position other than a hole in the blade, for example with a notch cut into the peripheral edge of the tang.

There are numerous other structural configurations that may be used for locking mechanisms that rely upon the same or equivalent lever arm mechanisms as described above. A sampling of alternate embodiments of the locking mechanism is lustrated in FIGS. 10 through 15. Beginning with FIGS. 10 and 11, the locking mechanism 100 is a separate piece from the handle side wall that is shown attached at one end thereof to a handle side wall 102 with suitable fasteners such as screws 114. The mechanism thus comprises a monolithic plate 104 of resilient material such as spring steel that includes a single U shaped slot 106 cut therethrough that defines a central lever arm 108 and two opposed spring arms 107 and 109 that are integrally connected to the central lever arm. The end of lever arm 108 that is at the closed end of U shaped slot 106 defines the actuating portion 110, and the lifting portion 112 of plate 104 is at the opposite, free end of plate 104. Screws 114 affix the end of plate 104 adjacent the actuating portion 110 to the side wall 102. This leaves the opposite end of plate 104 as a free end that may be lifted away from the resting, locked position into the unlocking position by actuation of the locking mechanism. A locking pin 76 is carried on the lifting portion 112 and extends inwardly to lock the blade as described above. Side wall 102 has an opening 116, one edge of which acts as a fulcrum 118. Plate 104 is attached to side wall 102 such that the actuating portion 110 of lever arm 108 is position such that the lever arm may be moved into opening 116 when actuated.

Figure 11:
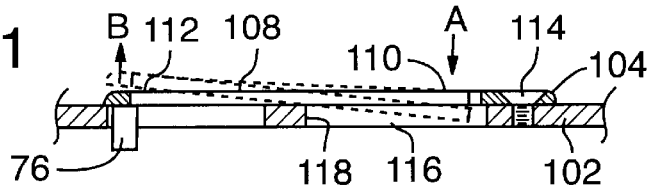
FIG. 11 is a partial fragmentary cross sectional view taken along the line 11—11 of FIG. 10.

It will be understood that as shown in FIG. 11, when actuating portion 110 is moved in the direction of arrow A, the lifting portion 112 of plate 104 moves in the opposite direction, represented by arrow B. Locking pin 76 or an equivalent blade engaging structure extends through the side wall into an engaging relationship with the blade or other working implement when the locking mechanism is in the resting position.

Figure 10:
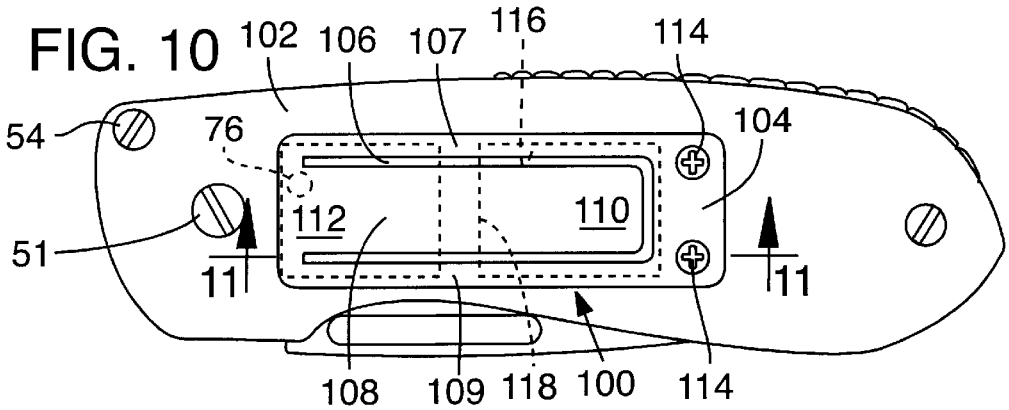
FIG. 10 is a left side elevational view of an alternative embodiment of a locking mechanism according to the present invention.
Figure 12:
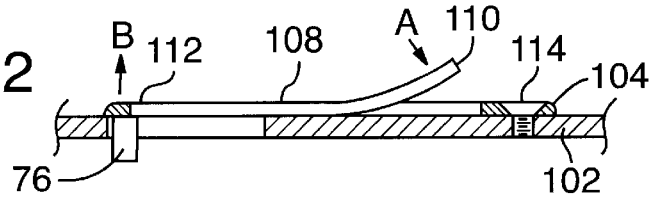
FIG. 12 is a partial fragmentary cross sectional view of another alternative embodiment of a locking mechanism according to the present invention.

FIG. 12 illustrates an alternate embodiment similar to the design shown in FIGS. 10 and 11, but which eliminates the opening 116 in side wall 102. In the embodiment of FIG. 12, the actuating portion 110 is bent upwardly, away from the surface of side wall 102. When actuating portion 110 is pushed in the direction of arrow A, lifting portion 112 is moved in the direction of arrow B to lift locking pin 76 out of the locking position. The side wall 102 acts as a fulcrum for lever arm 108 in the embodiment shown in FIG. 12.

Figure 13:
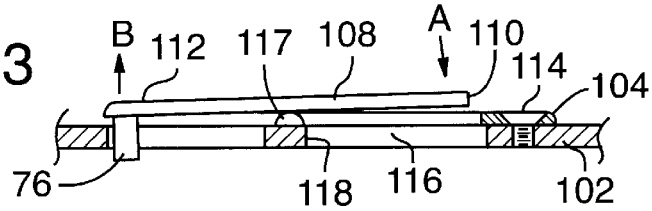
FIG. 13 is a partial fragmentary cross sectional view of yet another alternative embodiment of a locking mechanism according to the present invention.

FIG. 13 is an embodiment similar to FIG. 12 in a fulcrum 117 has been added to side wall 102 under lever arm 108. It will be appreciated that the amount of force required to raise lifting portion 112 and the distance that locking pin 76 travels may be varied by changing the position of the fulcrum relative to the lever arm. The amount of force necessary to lift the lifting portion may also be changed by the material used to make plate 104, the thickness of the plate, and the thickness of the opposed spring arms (such as 107, 109 in FIG. 10).

Figure 14:
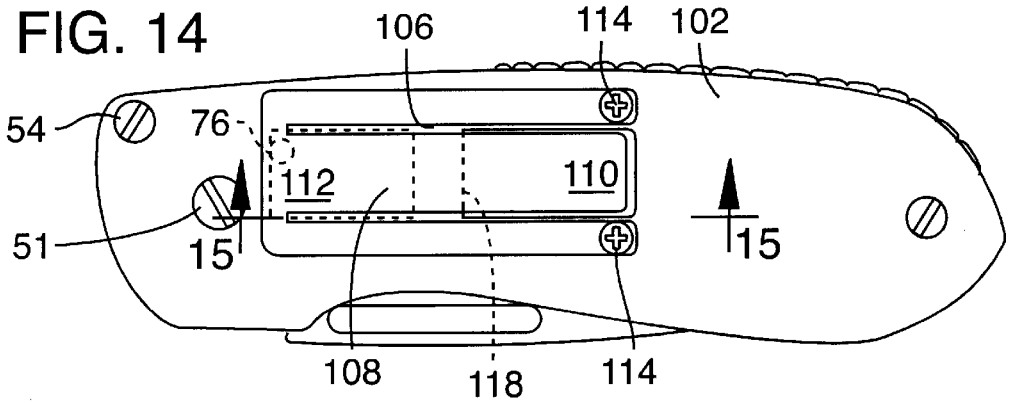
FIG. 14 is a left side elevational view of still another alternative embodiment of a locking mechanism according to the present invention.
Figure 15:
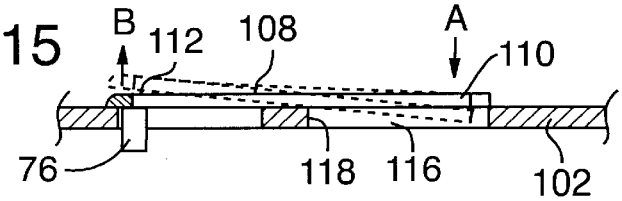
FIG. 15 is a partial fragmentary cross sectional view taken along the line 15—15 of FIG. 14.

FIGS. 14 and 15 illustrate yet another embodiment of a locking mechanism that incorporate the unitary lever arm and spring arms according to the concepts of the present invention. The embodiment shown in FIGS. 14 and 15 are similar to the embodiment shown in FIGS. 10 and 11.

Figure 16:
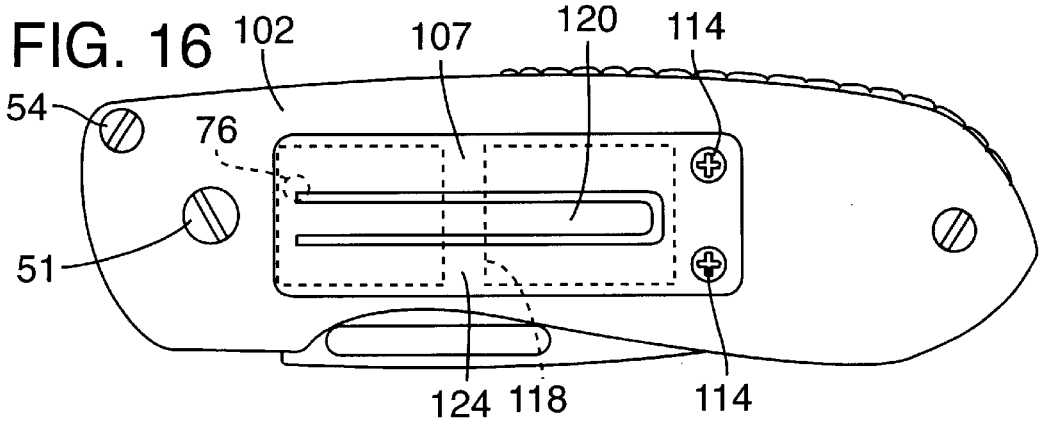
FIG. 16 is a left side elevational view of another alternate embodiment in which the widths of the spring arms in the locking mechanism are varied to vary the biasing resistance of the mechanism.

FIG. 16 illustrates an alternate embodiment in which the central lever arm 120 is relatively narrower than the two adjacent outer spring arms 122 and 124. By varying the relative widths of the spring arms the biasing resistance—that is, the amount of force needed to move the actuating portion inwardly to effect actuation of the locking mechanism, may be varied. In the example of FIG. 16, the amount of resistance—the spring force—is greater than the locking mechanism illustrated in FIG. 14.

Figure 17:
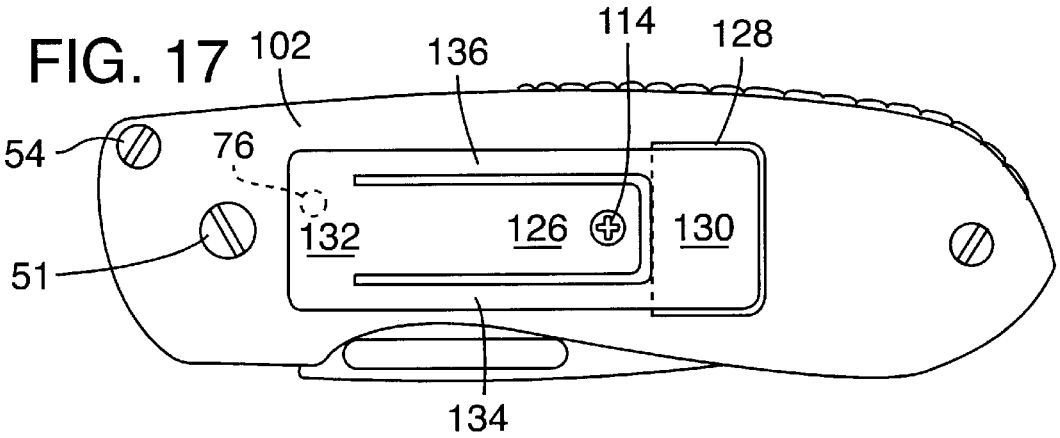
FIG. 17 is a left side elevational view of yet another alternate embodiment of a locking mechanism according to the present invention.

In FIG. 17 the central lever arm 126 is fixed to the underlying surface of handle side wall 102 with a screw 114. Side wall 102 has an opening 128 positioned such that end portion 130 of the locking mechanism may move inwardly into opening 128. In this instance the end portion 130 becomes the actuation portion of the mechanism. When end portion 130 is pushed inwardly toward the side wall, the lifting portion 132, which is at the opposite end of the mechanism, moves outwardly to disengage pin 76 from the blade. Spring arms 134 and 136 provide biasing resistance.

Figure 18:
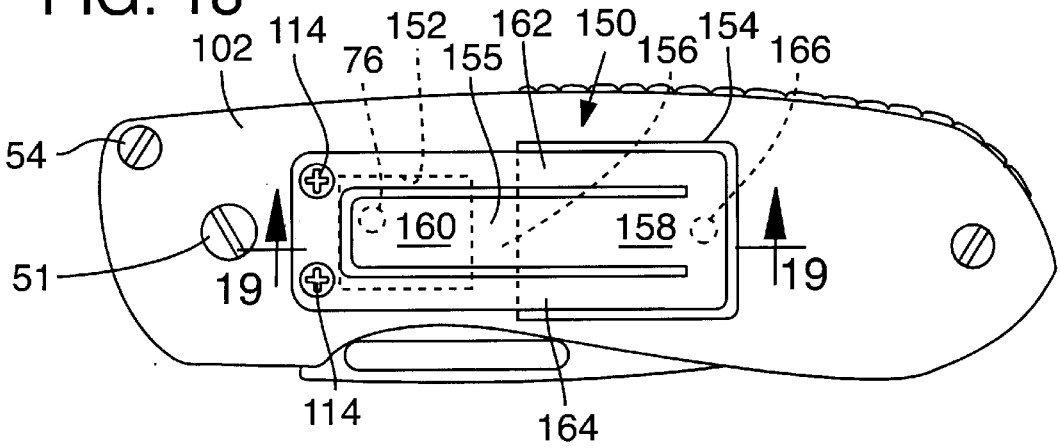
FIG. 18 is a left side elevational view of still another alternate embodiment of the locking mechanism according to the present invention.
Figure 19:
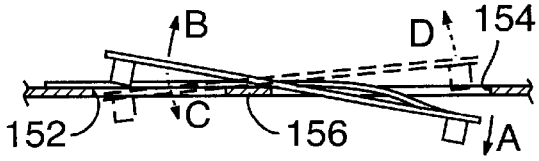
FIG. 19 is a partial fragmentary cross sectional view taken along the line 19—19 of FIG. 18.

A double acting mechanism is illustrated in FIG. 18 as just one of the many different embodiments of the present invention. In FIG. 18 locking mechanism 150 is shown as a separate unitary piece attached to side wall 102 with a pair of screws 114. A pair of openings 152 and 154, respectively, is formed in side wall 102 in positions under the opposite ends of the locking mechanisms. A fulcrum member 156 is defined between openings 152 and 154. With this configuration, each end of the central lever arm 155 may be used as the actuating portion. Thus, if central lever arm 155 is pushed at actuating portion 158 in the direction of arrow A in FIG. 19, lifting portion 160 moves out of the locking position as the central lever arm rocks on fulcrum 156. This disengages locking pin 76 from the blade as described above. The outer spring arms 162 and 164 provide biasing resistance to this movement. It will be appreciated that the end of central lever arm 155 labeled with reference number 160 may be pushed inwardly into the underlying opening 152, in the direction of arrow C in FIG. 19. This results in the end of central lever arm labeled 158 to move in the opposite direction—that is, in the direction of arrow D in FIG. 19, causing locking pin 166 to disengage from the blade. Again, the outer spring arms 162 and 164 resist this movement and will return the mechanism to the normal, locked position when pressure on the central lever arm is released.

Figure 20:
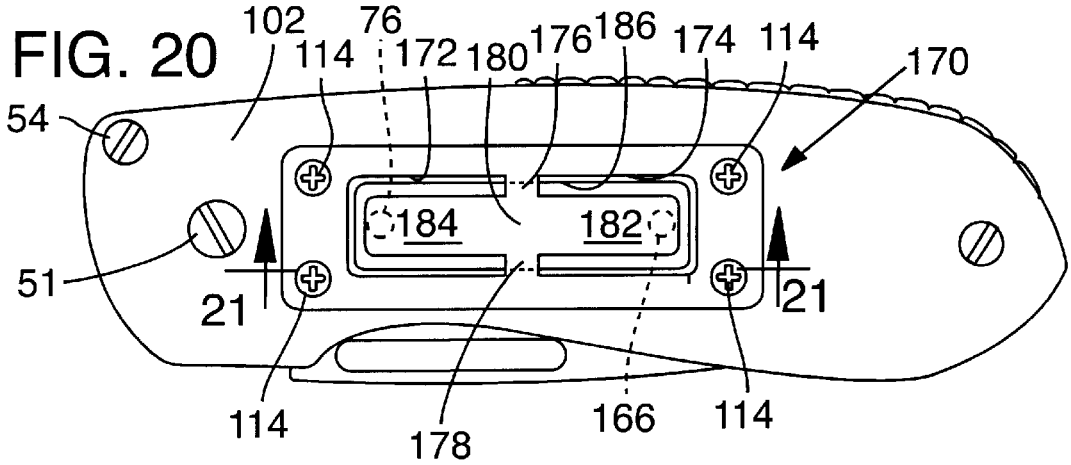
FIG. 20 is a left side elevational view of yet another alternate embodiment of a locking mechanism according to the present invention.
Figure 21:
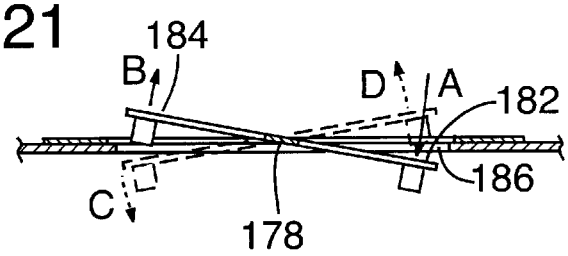
FIG. 21 is a partial fragmentary cross section view taken along the line 21—21 of FIG. 20.

Finally, another embodiment of the invention is shown in FIGS. 20 and 21 in which the spring arms define a torsion-type or twisted beam type of spring mechanism. With reference to FIG. 20, locking mechanism 170 is defined by a pair of facing U-shaped cutouts 172 and 174 that are spaced apart and define between the ends of the cutouts opposed spring arms 176 and 178. The U-shaped cutouts define a central lever arm 180 having opposite ends labeled 182 and 184, respectively. An opening 186 is formed in side wall 102 below central lever arm 180 and locking pins 76 and 166 are carried on opposite ends of the lever arm.

With reference to FIG. 21, it will be appreciated that pressure applied at end 182 of central lever arm 180 in the direction of arrow A will cause end 184 to move in the opposite direction (arrow B). Likewise, movement of end 184 in the opposite direction (i.e. the direction of arrow C) causes end 182 to move away from side wall 102 (arrow D). In either case, opposed spring arms 176 and 178 act as torsion springs or twisted beam type of springs to urge the locking mechanism back into the normally locked position when pressure exerted on the central lever arm is released. Those of skill in the art will appreciate that the resiliency characteristics of the mechanism may be varied widely according to such factors as the cross sectional configuration of the spring arms, their size, and the materials used to fabricate the mechanism.

The torsion locking mechanism illustrated in FIGS. 20 and 21 may be modified such that it is "inverted." This is done by fixing the opposite ends of the central lever arm at ends 182 and 184 to the side wall, for example, with screws. In this example the outer portions of the locking mechanism—that is, the portions outward of the U-shaped cutouts, would move into and out of the locking position.

Finally, it will be appreciated that the implement that is used with the locking mechanisms described herein need not be limited to a pivoting attachment to the handle. Thus, and by way of example, the tool may be readily modified such that the implement is moved longitudinally slidable into and out of the handle in a "stiletto" fashion while still incorporating the essential features of the locking mechanism. The implement could also be movable into and out of the open and closed positions in other equivalent manners and still utilize the locking mechanism described herein.

In view of the many possible embodiments to which the principles of our invention may be applied, it should be recognized that the detailed embodiments are illustrative only and should not be taken as limiting the scope of my invention. Rather, we claim as our invention all such embodiments as may come within the scope and spirit of the following claims and equivalents thereto.

What is claimed is:

1. A folding tool, comprising:

a handle having first and second opposed side walls held in a spaced-apart arrangement to define a slot therebetween;

an implement having a working portion and a tang portion, said tang portion pivotally attached to one end of the handle and said implement movable between a closed position in which the implement is at least partially received within the slot and an open position in which the implement is extended away from the handle;

an implement lock defined by a pair of slots in one of said side walls that cooperate to define a lever arm having a free end and an actuating end, said pair of slots further defining at least one spring member connected to said lever arm, and said lever arm having a locking pin on the free end and movable between a first position in which said locking pin engages said tang to lock said implement in said open position, and a second position in which the locking pin disengages said tang so that said implement may be moved into said closed position.

2. The folding tool according to claim 1 wherein said lever arm and said spring member are formed of a unitary piece of material.

3. The folding tool according to claim 1 including a pair of spring arms integrally connected to said lever arm on opposite sides thereof.

4. The folding tool according to claim 1 wherein said implement lock is carried by a side wall of said handle.

5. The folding tool according to claim 1 wherein said side wall and said implement lock define a unitary piece of material.

6. The folding tool according to claim 4 wherein said side wall and said implement lock define separate pieces of material that are affixed.

7. The folding tool according to claim 1 wherein said spring arm is normally in the first position.

8. The folding tool according to claim 1 including a fulcrum inwardly of said lever arm and intermediate along the length thereof.

9. The folding tool according to claim 1 wherein said locking mechanism is carried by one of said side walls and further comprises a member having a substantially U shaped slot cut therethrough to define said lever arm having an actuating portion at one end thereof and a lifting portion at the opposite end, and wherein said slot further defines a pair of spring arms in said member, said spring arms integrally connected to said lever arm.

10. The folding tool according to claim 9 wherein said member and said side wall are a unitary piece.

11. The folding tool according to claim 9 wherein said member and said side wall are separate pieces that are connected together.

12. The folding tool according to claim 9 including a second substantially U shaped slot cut through said member and oriented oppositely relative to and in an overlapping relationship with said first U shaped slot such that one of said U shaped slots is oriented inwardly of said other and such that the overlapping portions of the arms said overlapping U shaped slots define said spring arms.

13. The folding tool according to claim 1 wherein said tang includes a first locking pin receiving opening for receiving said locking pin when said implement is in said closed position to lock said implement in said closed position, and a second locking pin receiving opening for receiving said locking pin when said implement is in said open position to lock said implement in said open position.

14. A folding tool, comprising:

a handle having first and second opposed side walls held in a spaced-apart arrangement to define a slot therebetween;

an implement having a working portion and a tang, said tang pivotally attached to one end of the handle and said implement movable between a closed position in which the implement is at least partially received within the slot and an open position in which the implement is extended away from the handle;

an implement lock comprising an elongate lever arm formed by a pair of slots in one of said side walls, said lever arm having a lifting end and an actuating end and a locking pin connected to said lifting end, said locking pin extending inwardly in said handle toward said slot and engaging said tang when said lever arm is in a first position.

15. The folding tool according to claim 14 wherein said lever arm is normally in said first position.

16. The folding tool according to claim 14 including spring means integrally connected to said lever arm.

17. The folding tool according to claim 16 wherein said spring means and said lever arm are formed from a unitary piece of material.

18. The folding tool according to claim 17 wherein said unitary piece of material is one of said side walls.

19. The folding tool according to claim 17 wherein said unitary piece of material is connected to said side wall.

20. In a folding tool of the kind having a handle having first and second opposed side walls held in a spaced-apart arrangement to define a slot therebetween, and an implement having a working portion and a tang, said tang pivotally attached to one end of the handle and said implement movable between a closed position in which the implement is at least partially received within the slot and an open position in which the implement is extended away from the handle, the improvement comprising:

an implement lock defined by a lever arm pivotally connected to one of said side walls and movable between a first position in which a locking pin carried on one end of said lever arm engages said tang when said implement is in said open position and a second position in which said locking pin disengages said tang, wherein said lever arm is defined by two oppositely oriented U shaped slots formed in said one side wall.

21. The folding tool according to claim 20 wherein said lock mechanism further comprises a spring integrally connected to said lever arm, said spring configured for normally maintaining said lever arm in said first position and for providing biasing resistance to movement of said lever arm to said second position.

22. The folding tool according to claim 21 wherein said spring and said lever arm define a unitary piece of material.

23. The folding tool according to claim 22 wherein said lever arm and said spring are defined by a continuous slot cut through said unitary piece of material.

24. The folding tool according to claim 22 wherein said lever arm and said spring are defined by a pair of continuous slots cut through said unitary piece of material.

25. The folding tool according to claim 23 wherein said pair of continuous slots are not interconnected.

26. The folding tool according to claim 25 wherein one of said side walls defines said unitary piece of material.

27. The folding tool according to claim 26 wherein said pair of continuous slots are defined by a pair of overlapping substantially U shaped slots that are oriented oppositely one another and said spring is defined by the overlapping portions of said slots.

28. A locking mechanism for a folding tool having a handle and an implement rotatably connected to said handle, comprising, a lever arm formed by a pair of slots in said handle, said lever arm movable between an implement locking position and an implement unlocking position;

a spring defined by said pair of slots and integrally coupled to said lever arm such that said lever arm is normally in the implement locking position and said spring provides resistance against moving said lever arm into said implement unlocking position.

29. The locking mechanism according to claim 28 wherein said lever arm includes a free end and an actuating end, and including an implement engaging member on said free end.

30. The locking mechanism according to claim 29 wherein said implement engaging member engages said implement when said lever arm is in said implement locking position, and pressure applied to said actuating end when said lever is in said implement locking position causes said lever arm to move to said implement unlocking position.

31. The locking mechanism according to claim 28 wherein said handle comprises opposed spaced apart side walls, and said lever arm is an integral component of one of said side walls.

32. The locking mechanism according to claim 28 wherein said handle comprises opposed spaced apart side walls, and wherein said locking mechanism further comprises a pair of slots cut through one of said side walls to define said lever arm and said spring.

33. The locking mechanism according to claim 32 wherein each of said slots defines a substantially U shaped slot having opposite arm sections, and wherein said slots are oriented in opposite directions such that the opposite arm sections of one of said slots overlaps with the opposite arm sections of the other of said slots.

34. A folding tool comprising:

a handle having first and second opposed said walls held in a spaced-apart arrangement to define a slot therebetween;

a implement movable between a closed position in which the implement is at least partially received within the slot and an open position in which the implement is extended away from the handle;

an implement lock defining a lever arm integrally connected to a spring member, said lever arm having a free end and an actuating end and a locking surface on the free end, said lever arm movable between a first position in which said locking surface engages said implement to lock said implement in said open position, and a second position in which the locking pin disengages said implement so that said implement may be moved into said closed position.

35. A folding tool, comprising:

a handle having first and second opposed side walls held in a spaced-apart arrangement to define a slot therebetween;

an implement movable between a closed position in which the implement is at least partially received within the slot and an open position in which the implement is extended away from the handle;

a pair of slots in one of said side walls that define a lever arm and a spring member, said lever arm having a free end and an actuating end and a locking surface on the free end, said lever arm movable between a first position in which said locking surface engages said implement to lock said implement in said open position, and a second position in which the locking pin disengages said implement so that said implement may be moved into said closed position.

36. The folding tool according to claim 34 including a pair of spring arms integrally connected to said lever arm on opposite sides thereof and adjacent said free end.

37. The folding tool according to claim 34 including a pair of spring arms integrally connected to said lever arm.

38. The folding tool according to claim 34 wherein said side wall and said implement lock define a unitary piece of material.

39. The folding tool according to claim 34 wherein said spring arm is normally in the first position.

40. The folding tool according to claim 34 including a fulcrum inwardly of said locking member and intermediate along the length of the lever arm.

41. The folding tool according to claim 34 wherein said locking mechanism is carried by one of said side walls and further comprises a member having a substantially U shaped slot cut therethrough to define said lever arm having an actuating portion at one end thereof and a lifting portion at the opposite end, and wherein said slot further defines a pair of spring arms in said member, said spring arms integrally connected to said lever arm.

42. The folding tool according to claim 41 wherein said member and said side wall are a unitary piece.

43. The folding tool according to claim 41 including a second substantially U shaped slot cut through said member and oriented oppositely relative to and in an overlapping relationship with said first U shaped slot such one of said U shaped slots is oriented inwardly of said other and such that the overlapping portions of the arms said overlapping U shaped slots define said spring arms.

44. The folding tool according to claim 34 wherein said implement includes a first cooperative surface configured for engaging said locking surface when said implement is in said closed position to lock said implement in said closed position, and a second cooperative surface configured for engaging said locking surface when said implement is in said open position to lock said implement in said open position.

* * * * *